US012467725B2

(12) United States Patent
Lamanna et al.

(10) Patent No.: US 12,467,725 B2
(45) Date of Patent: Nov. 11, 2025

(54) DART THROWING GAME SYSTEM

(71) Applicants: James Lamanna, Katy, TX (US); Sean Tobey, Katy, TX (US); Trent Railey, Katy, TX (US)

(72) Inventors: James Lamanna, Katy, TX (US); Sean Tobey, Katy, TX (US); Trent Railey, Katy, TX (US)

( * ) Notice: Subject to any disclaimer, the term of this patent is extended or adjusted under 35 U.S.C. 154(b) by 343 days.

(21) Appl. No.: 18/104,642

(22) Filed: Feb. 1, 2023

(65) Prior Publication Data

US 2024/0255265 A1 Aug. 1, 2024

(51) Int. Cl.

| | |
|---|---|
| ***A63F 9/02*** | (2006.01) |
| ***F41J 3/00*** | (2006.01) |
| ***F41J 3/02*** | (2006.01) |

(52) U.S. Cl.

CPC ..... *F41J 3/02* (2013.01); *A63F 9/0204* (2013.01); *F41J 3/0009* (2013.01)

(58) Field of Classification Search

None

See application file for complete search history.

(56) References Cited

U.S. PATENT DOCUMENTS

| | | | | |
|---|---|---|---|---|
| 8,113,930 | B1 | 2/2012 | Coats | |
| 8,162,731 | B2 * | 4/2012 | Noda | F41J 5/14 273/374 |
| 9,739,575 | B2 * | 8/2017 | Hong | F41J 5/04 |
| 10,317,177 | B2 * | 6/2019 | Dale | G06T 7/73 |
| 10,443,987 | B2 * | 10/2019 | Hollinger | F41J 5/10 |
| 10,600,209 | B2 | 3/2020 | Liu | |
| D883,387 | S | 5/2020 | Zammuto | |
| 2010/0176555 | A1 * | 7/2010 | Noda | F41J 3/00 473/578 |
| 2011/0031696 | A1 | 2/2011 | Su | |
| 2012/0083342 | A1 * | 4/2012 | Cross | F41J 3/0009 273/371 |
| 2014/0151965 | A1 * | 6/2014 | Garas | F41J 3/0004 273/371 |
| 2017/0167832 | A1 * | 6/2017 | Hong | F41J 5/00 |
| 2017/0191805 | A1 * | 7/2017 | Teng | F41J 3/02 |
| 2017/0252654 | A1 * | 9/2017 | Hong | F41J 3/0009 |
| 2017/0307341 | A1 * | 10/2017 | Hollinger | F41J 5/14 |
| 2017/0326444 | A1 * | 11/2017 | Hong | A63F 9/0208 |
| 2019/0184274 | A1 * | 6/2019 | Hong | F41J 3/0009 |

FOREIGN PATENT DOCUMENTS

| | | |
|---|---|---|
| WO | WO2016203194 | 12/2016 |

* cited by examiner

*Primary Examiner* — Sunit Pandya

(57) ABSTRACT

A dart throwing game system for wirelessly communicating with multiple players includes a dart throwing game including a dartboard having a front surface and a plurality of darts being removably couplable to the dartboard. A monitor and scoreboard assembly monitors the dart throwing game and displays a score from the dart throwing game and is wirelessly communicable with at least one other assembly. The monitor and scoreboard assembly comprises a monitor tracking a position of each dart on the dartboard and recording the score of the dart throwing game. A display is mountable to a wall and receives the score from the monitor, wherein the display displays the score of the dart throwing game.

1 Claim, 8 Drawing Sheets

DART THROWING GAME SYSTEM

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to dart-throwing game scoreboards and more particularly pertains to a new dart-throwing game scoreboard for wirelessly communicating with multiple players.

(2) Description of Related Art Including Information Disclosed Under 37 CFR 1.97 and 1.98

The prior art relates to dart-throwing game scoreboards and includes a variety of scoreboards being digital. Known prior art does not include a dart-throwing game scoreboard having a monitor for tracking a position of darts and being in wireless communication with a display screen showing a score of the dart-throwing game.

(h) BRIEF SUMMARY OF THE INVENTION

An embodiment of the disclosure meets the needs presented above by generally comprising a dart throwing game including a dartboard having a front surface and a plurality of darts being removably couplable to the dartboard. Each dart includes a shaft having a front end and a back end and the shaft is configured for being held by a hand of a user of each dart. A point is coupled to the front end of the shaft and is pointed such that each dart is removably penetrable to the front surface of the dartboard. A flight is coupled to the back end of the shaft and is capable of gliding each dart through the air after being launched from the hand of the user. A monitor and scoreboard assembly monitors the dart throwing game and displays a score from the dart throwing game and is wirelessly communicable with at least one other assembly. The monitor and scoreboard assembly comprises a monitor tracking a position of each dart on the dartboard and recording the score of the dart throwing game. A display is mountable to a wall and receives the score from the monitor, wherein the display displays the score of the dart throwing game.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
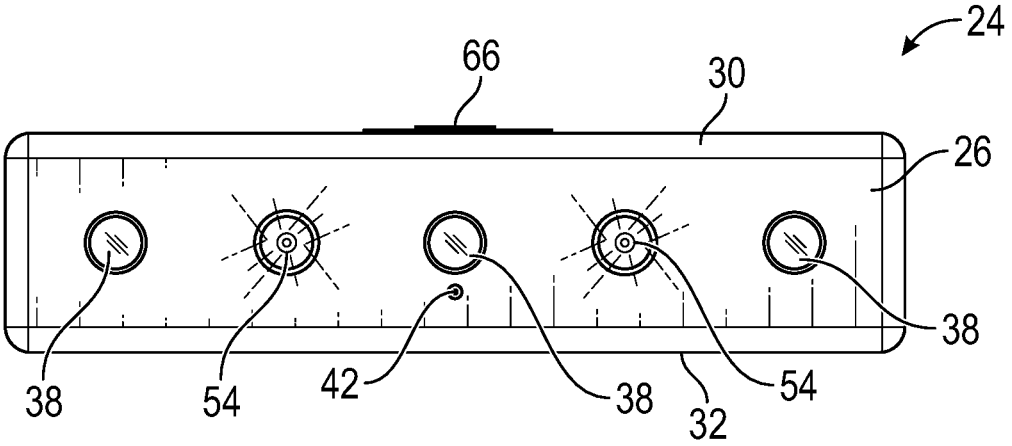
FIG. 1 is a front view of a dart throwing game system according to an embodiment of the disclosure.
Figure 2:
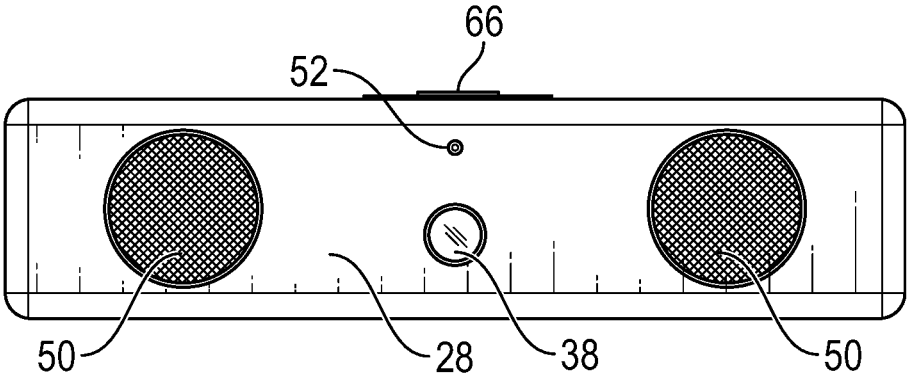
FIG. 2 is a back view of an embodiment of the disclosure.
Figure 3:
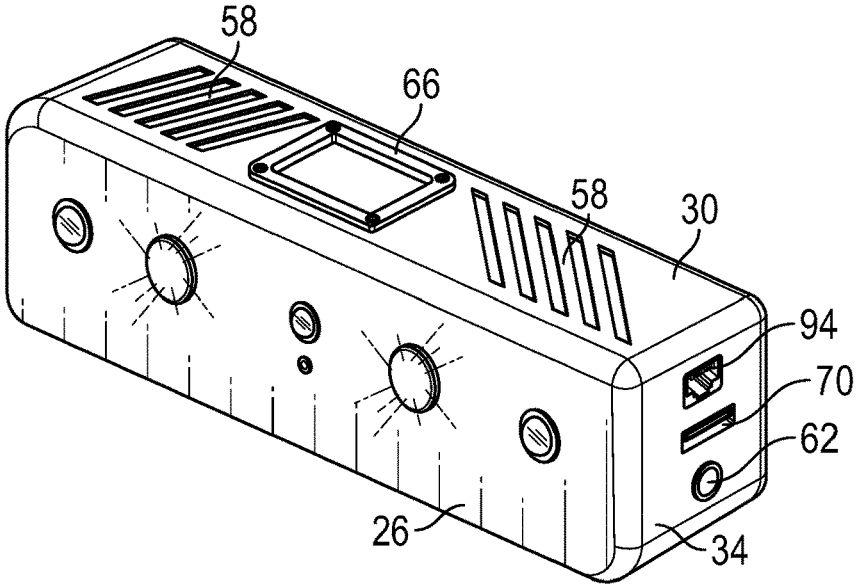
FIG. 3 is a top isometric view of an embodiment of the disclosure.
Figure 4:
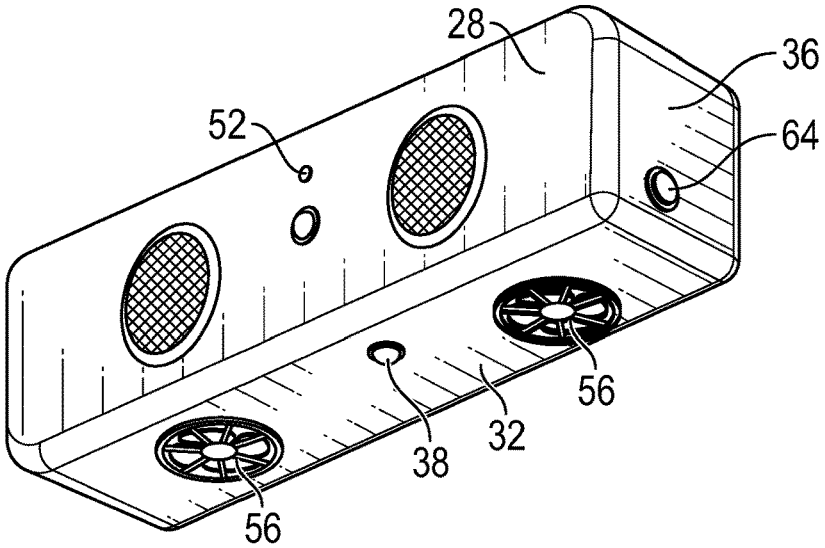
FIG. 4 is a bottom isometric view of an embodiment of the disclosure.
Figure 5:
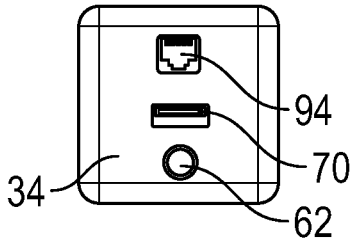
FIG. 5 is a right side view of an embodiment of the disclosure.
Figure 6:
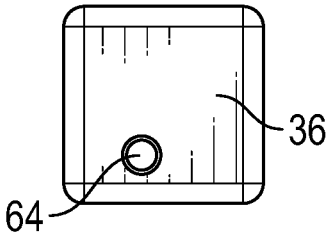
FIG. 6 is a left view of an embodiment of the disclosure.
Figure 7:
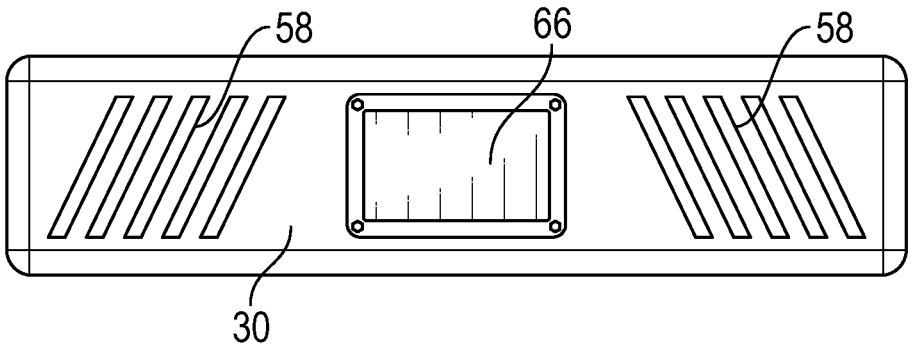
FIG. 7 is a top view of an embodiment of the disclosure.
Figure 8:
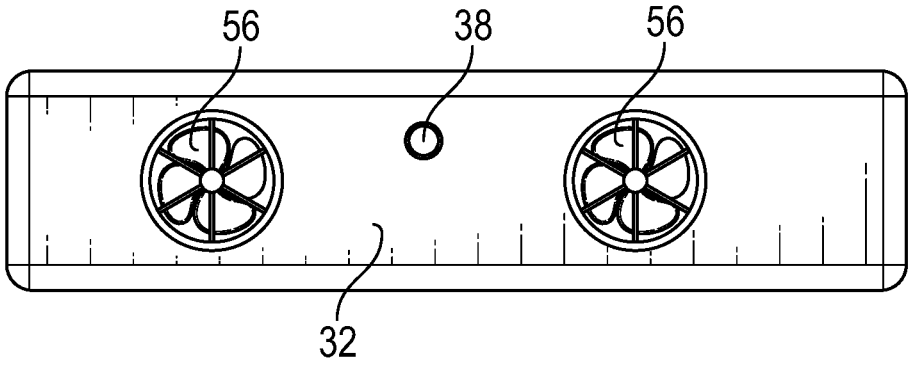
FIG. 8 is a bottom view of an embodiment of the disclosure.
Figure 9:
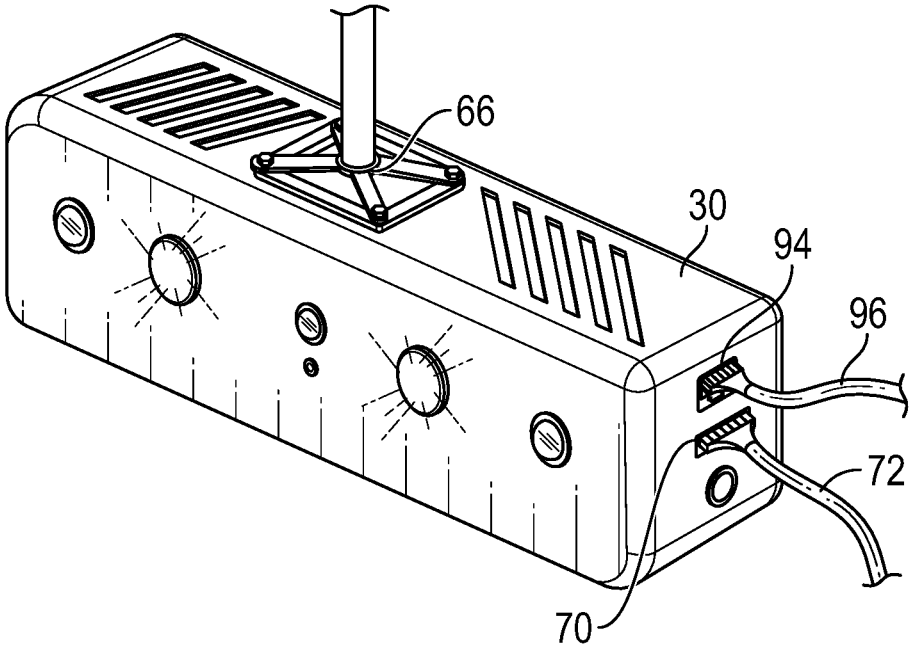
FIG. 9 is an in-use view of an embodiment of the disclosure.
Figure 10:
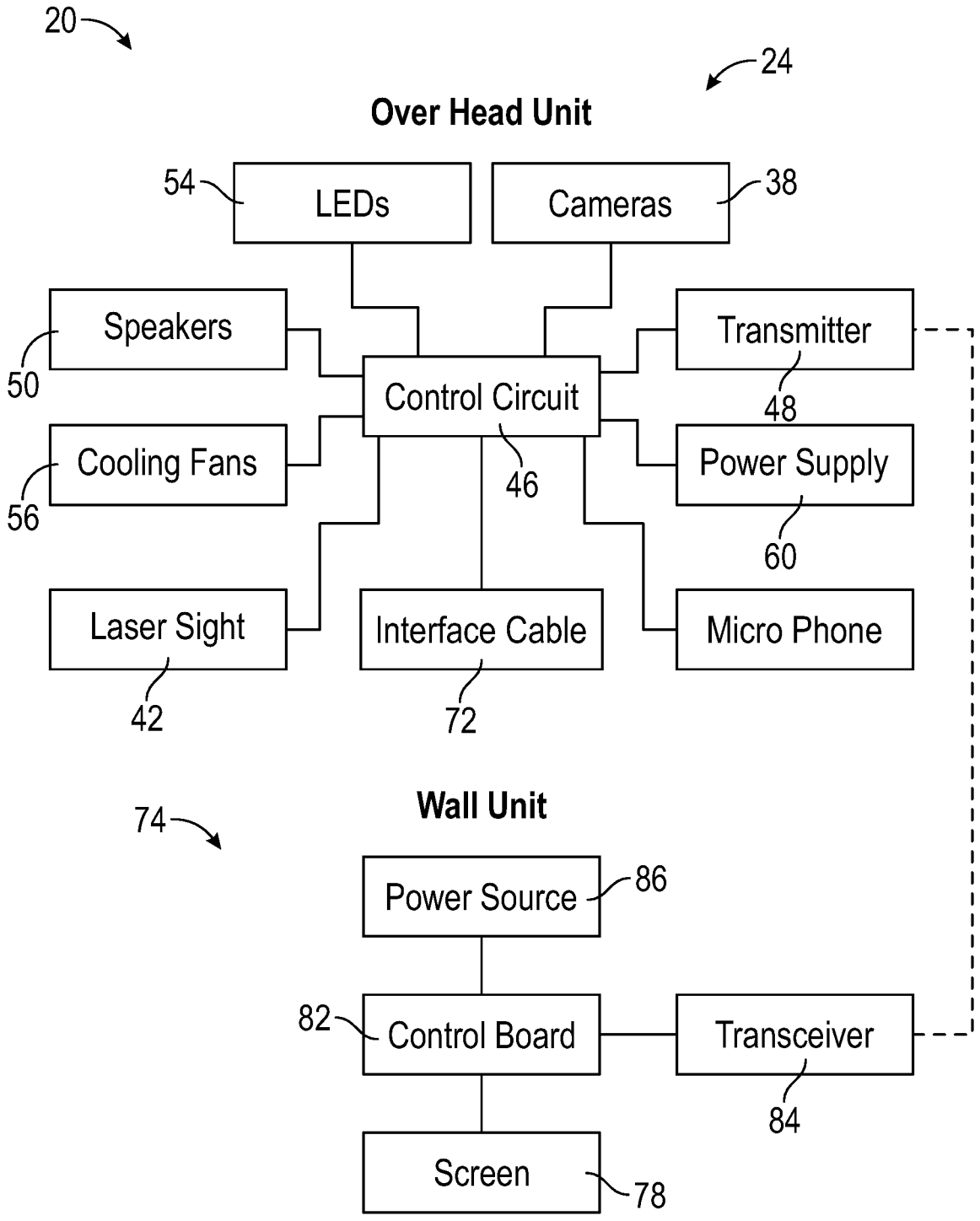
FIG. 10 is a block diagram view of an embodiment of the disclosure.
Figure 11:
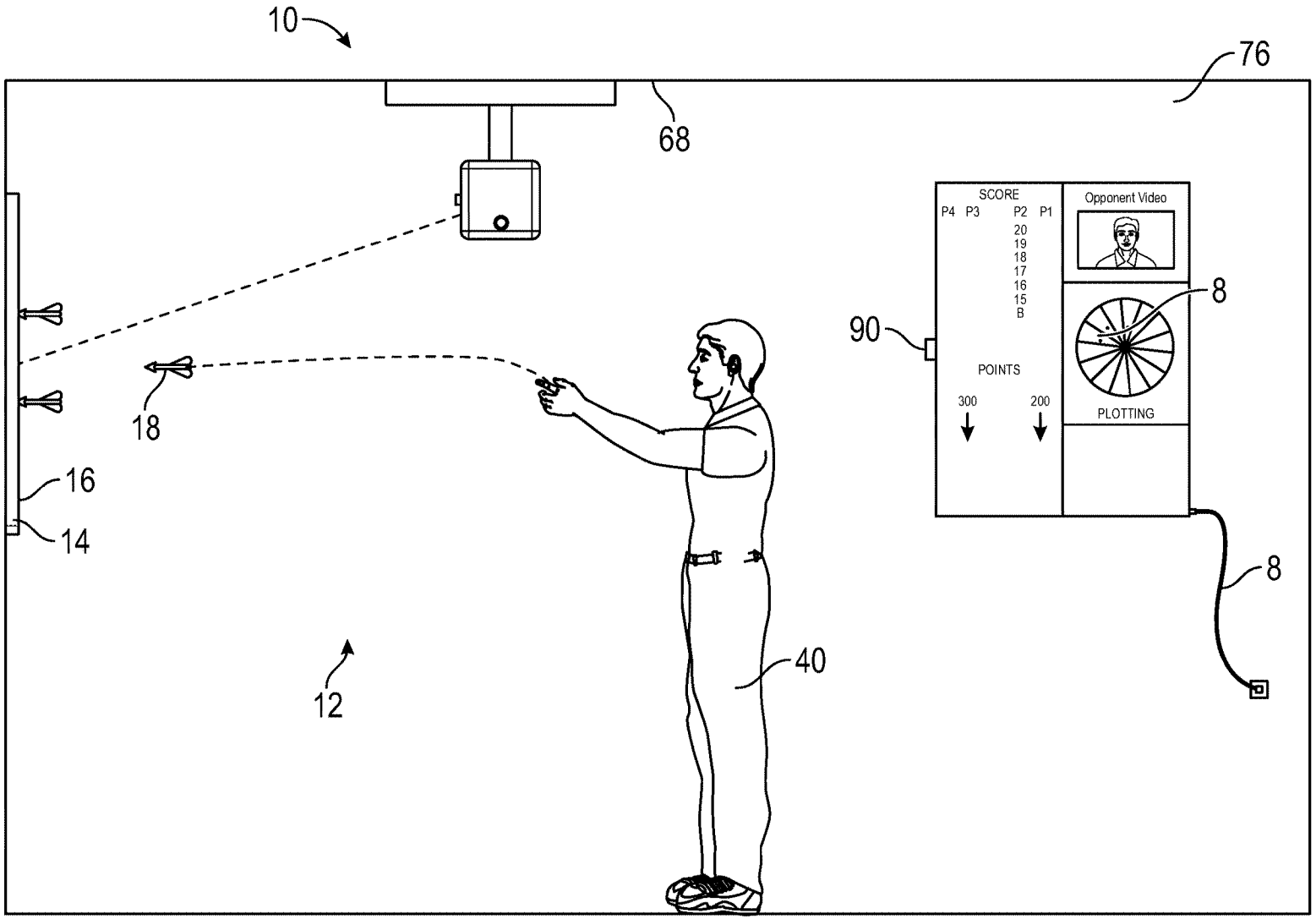
FIG. 11 is an in-use view of an embodiment of the disclosure.
Figure 12:
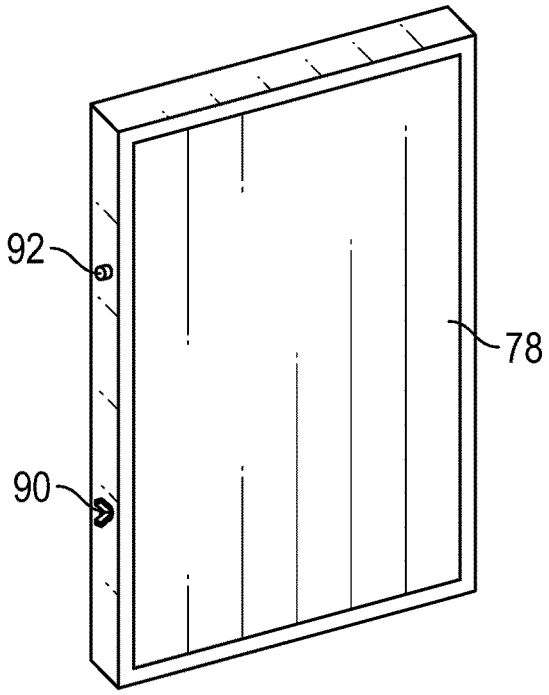
FIG. 12 is a front isometric view of an embodiment of the disclosure.
Figure 13:
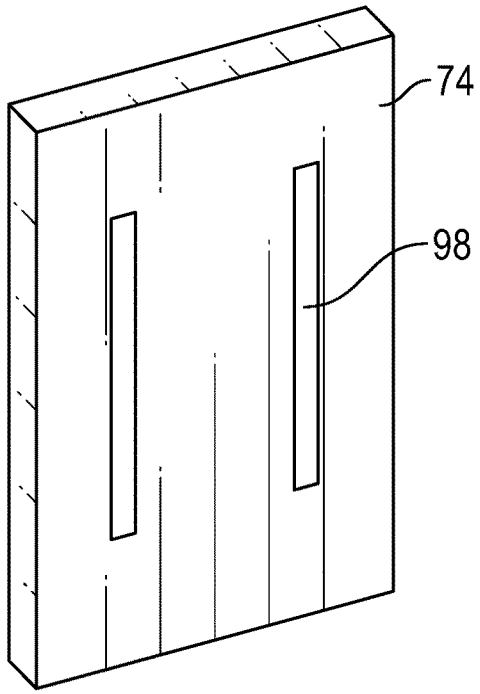
FIG. 13 is a back isometric view of an embodiment of the disclosure.

With reference now to the drawings, and in particular to FIGS. 1 through 13 thereof, a new dart throwing game embodying the principles and concepts of an embodiment of the disclosure and generally designated by the reference numeral 10 will be described.

As best illustrated in FIGS. 1 through 13, the dart throwing game system 10 generally comprises As best illustrated in FIGS. 1 through 6, the dart throwing game system 10 generally comprises a dart throwing game 12 including a dartboard 14 having a front surface 16 and a plurality of darts 18 is removably couplable to the dartboard 14. Each dart 18 typically includes a shaft having a front end and a back end. The shaft is configured for being held by a hand of a user of each dart 18. A point is coupled to the front end of the shaft and is normally pointed such that each dart is removably penetrable to the front surface 16 of the dartboard 14. A flight is coupled to the back end of the shaft and is capable of gliding each dart 18 through the air after being launched from the hand of the user.

An overhead and wall assembly 20 monitors the dart throwing game 12 and displays a score 22 from the dart throwing game 12 and is wirelessly communicable with at least one other assembly. The overhead and wall assembly 20 comprises a monitor 24 tracking a position of each dart 18 on the dartboard 14 and recording the score 22 of the dart throwing game 12. The monitor 24 typically includes a housing having a front wall 26, a back wall 28, a top wall 30, a bottom wall 32, a first side wall 34, and a second side wall 36. The front wall 26 is normally positionable facing the dartboard 14.

A plurality of cameras 38 is mounted on the front wall 26, the back wall 28, and the bottom wall 32. The cameras 38 of the front wall 26 monitor the position of the darts 18 on the dartboard 14, and the camera 38 of the back wall 28 visually records a player 40 of the dart throwing game 12. The camera 38 of the bottom wall 32 may visually record the dartboard 14 or the player 40. A laser beam emitter 42 is coupled to the front wall 26 and is actuated to emit a laser beam towards a center 44 of the front surface 16 of the dartboard 14, wherein the laser beam emitter 42 facilitates monitoring the position of the darts 18 relative to the center 44 of the dartboard 14.

A control circuit 46 is electrically coupled to the cameras 38 and to the laser beam emitter 42. The control circuit 46 is normally positioned within the monitor 24. A transmitter 48 is electrically coupled to the control circuit 46 and a plurality of speakers 50 is electrically coupled to the control circuit 46 and is actuated to emit audio. Each speaker 50 is normally coupled to the back wall 28 facing towards the player 40. A microphone 52 is electrically coupled to the control circuit 46 and is actuated to pick up and transmit audio from the player 40. The microphone 52 is typically coupled to the back wall 28.

A plurality of light emitters 54 is electrically coupled to the control circuit 46 and is actuated to emit light. Each light emitter 54 may be coupled to the front wall 26. A plurality of fans 56 is electrically coupled to the control circuit 46 and is actuated to blow air within the housing of the monitor 24, wherein the fans 56 prevent overheating an interior space of the monitor 24. Each fan 54 is typically coupled to the bottom wall 32. A plurality of vents 58 is positioned on the top wall 30 and extends therethrough. The vents 58 ventilate the interior space of the monitor 24.

A power supply 60 is electrically coupled to the control circuit 46 and may comprise a rechargeable battery. The power supply may have a charging port 62 positioned on the first side wall 34 for receiving a charging cord. An actuator 64 is electrically coupled to the control circuit 46 and is actuated by the player 40 to power on or off the monitor 24. The actuator may be positioned on the second side wall 36 of the monitor. A mount 66 is coupled to the top wall 30 and is removably securable to a ceiling 68, wherein the mount 66 removably mounts the monitor 24 to the ceiling 68. An input 70 for a connection cord 72 may be positioned on the first side wall 34 and be electrically coupled to the control circuit 46. The monitor may also have an internet port 94 being receivable for an internet cord 96, wherein the internet cord 96 connects the monitor to the internet.

A display 74 is mountable to a wall 76 by a coupler 98 such as adhesive strips and receives the score 22 from the monitor 24, wherein the display 74 displays the score 22 of the dart throwing game 12. The display 74 includes a screen 78 being electronic and being actuated to display indicia 80 of the score 22 of the dart throwing game 12. The indicia 80 of the score 22 may include a dartboard with the position of each dart 18. The screen 78 may be touch screen and include controls for the assembly 20. The screen 78 may also allow the player 40 to view the visual recording of a player from another assembly. A control board 82 is electrically coupled to the screen 78 and a transceiver 84 is electrically coupled to the control board 82 and is in wireless communication with the transmitter 48 of the monitor 24. A power source 86 is electrically coupled to the control board 82 and may comprise a power cord 88. A switch 90 is electrically coupled to the control board 82 and is engaged with by the player 40 to turn off or on the display 74. The display 74 may have a receiving port 92 for receiving the connection cord 72 from the monitor 24.

In use, the player 40 actuates the display 74 and the monitor 24 prior to beginning the dart throwing game 12. The player 40 may connect with at least one other player wirelessly, such that the transceiver 84 of the display wirelessly connects with another assembly. The visual recording of the other player may be displayed on the screen 78 of the display during the game 12. As each player throws the dart 18 to the dartboard 14, the cameras 38 of the monitor 24 track the location of each dart 18 to determine the score 22 of each player 40. The score 22 of the dart throwing game 12 is displayed on the screen 78 of each assembly.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A wireless game system configured for a person to play a game with another person remotely, the wireless game system comprising:

a dart throwing game including:

a dartboard having a front surface;

a plurality of darts being removably couplable to the dartboard, each dart including:

a shaft having a front end and a back end, the shaft being configured for being held by a hand of a user of each dart;

a point being coupled to the front end of the shaft, the point being pointed such that each dart being removably penetrable to the front surface of the dartboard; and a flight being coupled to the back end of the shaft and being capable of gliding each dart through the air after being launched from the hand of the user;

an overhead and wall assembly monitoring the dart throwing game and displaying a score from the dart throwing game and being wirelessly communicable with at least one other assembly, the overhead and wall assembly comprising:

a monitor tracking a position of each dart on the dartboard and recording the score of the dart throwing game, the monitor including:

a housing having a front wall, a back wall, a top wall, a bottom wall, a first side wall, and a second side wall, the front wall being positionable facing the dartboard;

a plurality of cameras being mounted on the front wall, the back wall, and the bottom wall, the cameras of the front wall monitoring the position of the darts on the dartboard, the cameras of the back wall visually recording a player of the dart throwing game, the camera of the bottom wall visually recording the dartboard;

a laser beam emitter being coupled to the front wall and being actuated to emit a laser beam towards a center of the front surface of the dartboard, wherein the laser beam emitter facilitates monitoring the position of the darts relative to the center of the dartboard;

a control circuit being electrically coupled to the cameras and to the laser beam emitter, the control circuit being positioned within the housing;

a transmitter being electrically coupled to the control circuit;

a plurality of speakers being electrically coupled to the control circuit and being actuated to emit audio, each speaker being coupled to the back wall;

a microphone being electrically coupled to the control circuit and being actuated to pick up and transmit audio, the microphone being coupled to the back wall;

a plurality of light emitters being electrically coupled to the control circuit and being actuated to emit light, each light emitter being coupled to the front wall;

a plurality of fans being electrically coupled to the control circuit and being actuated to blow air within the housing, wherein the fans prevent overheating an interior space of the housing, each fan being coupled to the bottom wall;

a plurality of vents being positioned on the top wall and extending therethrough, the vents ventilating the interior space of the housing;

a power supply being electrically coupled to the control circuit;

an actuator being electrically coupled to the control circuit and being actuated by the player to power on or off the monitor; and a mount being coupled to the top wall and being removably securable to a ceiling, wherein the mount removably mounts the monitor to the ceiling; and a display being mountable to a wall and receiving the score from the monitor, wherein the display displays the score of the dart throwing game, the display including:

a screen being electronic and being actuated to display indicia of the score of the dart throwing game;

a control board being electrically coupled to the screen;

a transceiver being electrically coupled to the screen and being in wireless communication with the transmitter of the monitor;

a power source being electrically coupled to the control board; and a switch being electrically coupled to the control board and being engaged with by the player to turn off or on the display.

* * * * *